US007764257B2

(12) United States Patent
Park

(10) Patent No.: US 7,764,257 B2
(45) Date of Patent: Jul. 27, 2010

(54) APPARATUS AND METHOD FOR CONTROLLING GATE VOLTAGE OF LIQUID CRYSTAL DISPLAY

(75) Inventor: Chang Ju Park, Jinju-si (KR)

(73) Assignee: LG Display Co., Ltd., Seoul (KR)

( * ) Notice: Subject to any disclaimer, the term of this patent is extended or adjusted under 35 U.S.C. 154(b) by 842 days.

(21) Appl. No.: 11/442,237

(22) Filed: May 30, 2006

(65) Prior Publication Data

US 2006/0290640 A1 Dec. 28, 2006

(30) Foreign Application Priority Data

Jun. 28, 2005 (KR) ..... 10-2005-0056531

(51) Int. Cl.
*G09G 3/36* (2006.01)

(52) U.S. Cl. ..... 345/94; 345/87; 345/98; 345/211

(58) Field of Classification Search ..... 345/87–111, 345/211, 212
See application file for complete search history.

(56) References Cited

U.S. PATENT DOCUMENTS 4,151,425 A 4/1979 Cappa
5,587,722 A * 12/1996 Suzuki et al. ..... 345/94
7,015,904 B2 * 3/2006 Kim ..... 345/212
2001/0033266 A1 * 10/2001 Lee ..... 345/94
2002/0190937 A1 * 12/2002 Song ..... 345/87
2003/0034965 A1 * 2/2003 Kim ..... 345/211
2003/0076138 A1 4/2003 Hwang
2005/0088391 A1 4/2005 Kim

FOREIGN PATENT DOCUMENTS

DE 28 10 641 A1 9/1978
DE 199 44 724 A1 8/2000
DE 20 2004 011 706 U1 9/2004

* cited by examiner

*Primary Examiner*—Amare Mengistu
*Assistant Examiner*—Dmitriy Bolotin
(74) *Attorney, Agent, or Firm*—McKenna Long & Aldridge

(57) ABSTRACT

Gate voltage controlling apparatus and method wherein a gate voltage may be applied to a gate driver sequentially from a lower voltage toward a higher voltage to stably drive and protect the gate driver, thereby minimizing any defects in the gate driver. In the gate controlling apparatus, a power supply generates at least two gate voltages having a different voltage level. A gate driver generates a scanning pulse that selects a display line using the at least two gate voltages having a different voltage level. A gate voltage controller supplies the gate voltages to the gate driver in sequence from a lower voltage toward a higher voltage.

5 Claims, 7 Drawing Sheets

APPARATUS AND METHOD FOR CONTROLLING GATE VOLTAGE OF LIQUID CRYSTAL DISPLAY

This application claims the benefit of Korean Patent Application No. P2005-056531, filed on Jun. 28, 2005, which is hereby incorporated by reference for all purposes as if fully set forth herein.

BACKGROUND OF THE INVENTION

1. Field of the Invention

The present invention relates to a liquid crystal display, and more particularly to a gate voltage controlling apparatus and method wherein a gate voltage can be applied to a gate driver sequentially from a lower voltage followed by a higher voltage for the purpose of stably driving and protecting the gate driver, thereby minimizing any defects in the gate driver.

2. Discussion of the Related Art

Generally, liquid crystal displays (LCD) are being more widely used because of its desirable characteristics, such as light weight, thin profile and low power consumption, etc. Accordingly, the LCD has been used for office automation equipment and video/audio equipment, etc. The LCD controls the amount of light transmitted in response to a data signal applied to a plurality of control switches arranged on a liquid crystal display panel in a matrix to thereby display a desired picture on the screen.

In the liquid crystal display panel, a plurality of data lines and a plurality of scan lines are arranged to cross each other and liquid crystal cells between upper and lower substrates are arranged in a matrix. Further, the liquid crystal display panel is provided with pixel electrodes and common electrodes for applying an electric field to each liquid crystal cell. The crossings between the plurality of data lines and the plurality of scan lines is provided with thin film transistors (TFT's) for switching a data voltage to a pixel electrode in response to a scanning signal. In such a liquid crystal display panel, gate drive integrated circuits are electrically connected, via a tape carrier package (TCP), to data drive integrated circuits.

FIG. 1 schematically shows a typical liquid crystal display module.

Referring to FIG. 1, the liquid crystal display module includes a liquid crystal display panel 10, a data driver 12, a gate driver 13, and a source printed circuit board 11 provided with first and second power supplies 14 and 15. A gate high voltage VGH and a gate low voltage VGL generated by the first and second power supplies 14 and 15 are applied, via a line on glass (LOG), to the gate driver 13. At this time, although the gate high voltage VGH and the gate low voltage VGL have a voltage difference from each other, they are applied to the gate driver 13 irrespective of a certain sequence according to a voltage level. For this reason, if the gate high voltage VGH having a 20V higher level than the gate low voltage VGL is applied to the gate driver 13 at an earlier time than the gate low voltage VGL, there may be caused a damage of the gate driver 13.

SUMMARY OF THE INVENTION

Accordingly, the present invention is directed to an apparatus and method for controlling a gate voltage of liquid crystal display that substantially obviates one or more of the problems due to limitations and disadvantages of the related art.

An advantage of the present invention is to provide a gate voltage controlling apparatus and method wherein a gate voltage can be applied to a gate driver sequentially from a lower voltage followed by a higher voltage for the purpose of stably driving and protecting the gate driver, thereby minimizing any defects in the gate driver.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a gate voltage controlling apparatus for a liquid crystal display comprises power supply that generates at least two gate voltages having different voltage levels; a gate driver that generates a scanning pulse that selects a display line using the at least two gate voltages having different voltage levels; and gate voltage control means that supplies the gate voltages to the gate driver in a sequence from a lower voltage toward a higher voltage.

In another aspect of the present invention, a gate voltage controlling apparatus for a liquid crystal display comprises a power supply that generates at least two gate voltages having different voltage levels; a gate driver that generates a scanning pulse that selects a display line using the at least two gate voltages having different voltage levels; and a gate voltage control means that delays a higher voltage of the voltages to be supplied to the gate driver.

In another aspect of the present invention, a gate voltage controlling method for a liquid crystal display comprises generating at least two gate voltages having different voltage levels; supplying the gate voltages to the gate driver in a sequence from a lower voltage toward a higher voltage; and allowing the gate driver supplied with the gate voltages to generate a scanning pulse for selecting a display line.

It is to be understood that both the foregoing general descriptions and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings, in which.

In the drawings.

DETAILED DESCRIPTION OF THE ILLUSTRATED EMBODIMENT

Reference will now be made in detail to an embodiment of the present invention, example of which is illustrated in the accompanying drawings.

Figure 1:
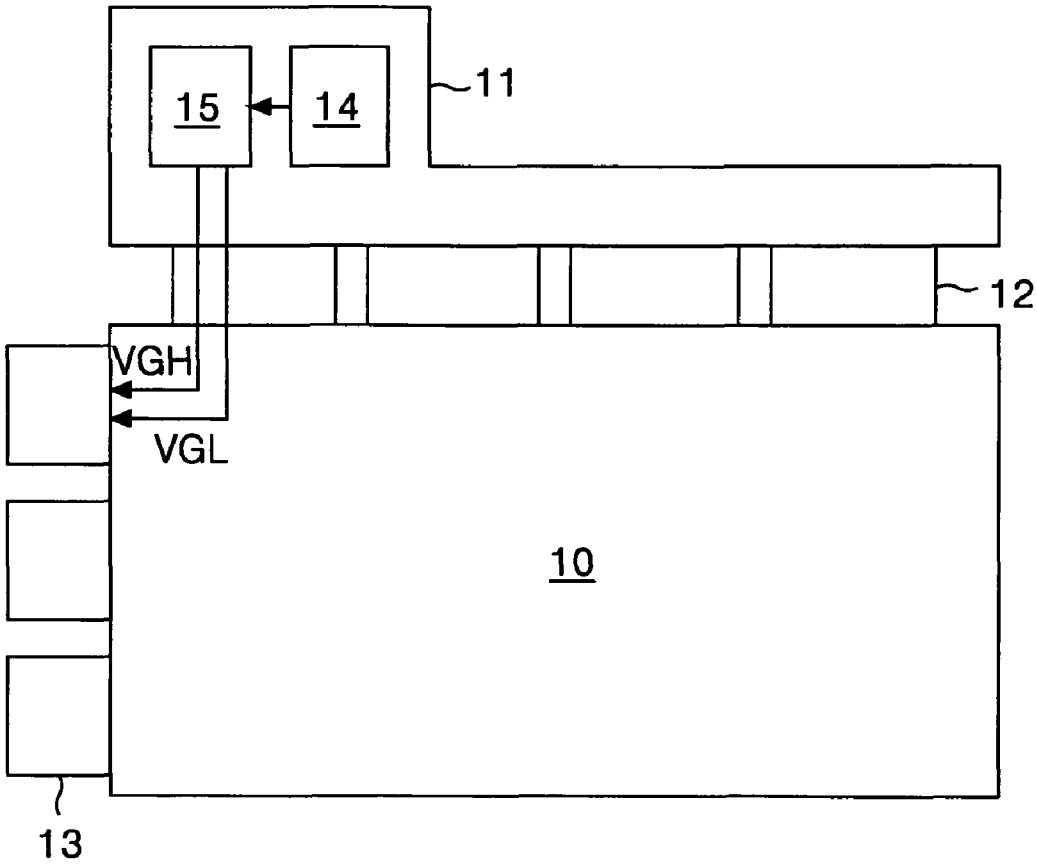
FIG. 1 RELATED ART
FIG. 1 is a schematic plan view showing a configuration of a general liquid crystal display module.
Figure 2:
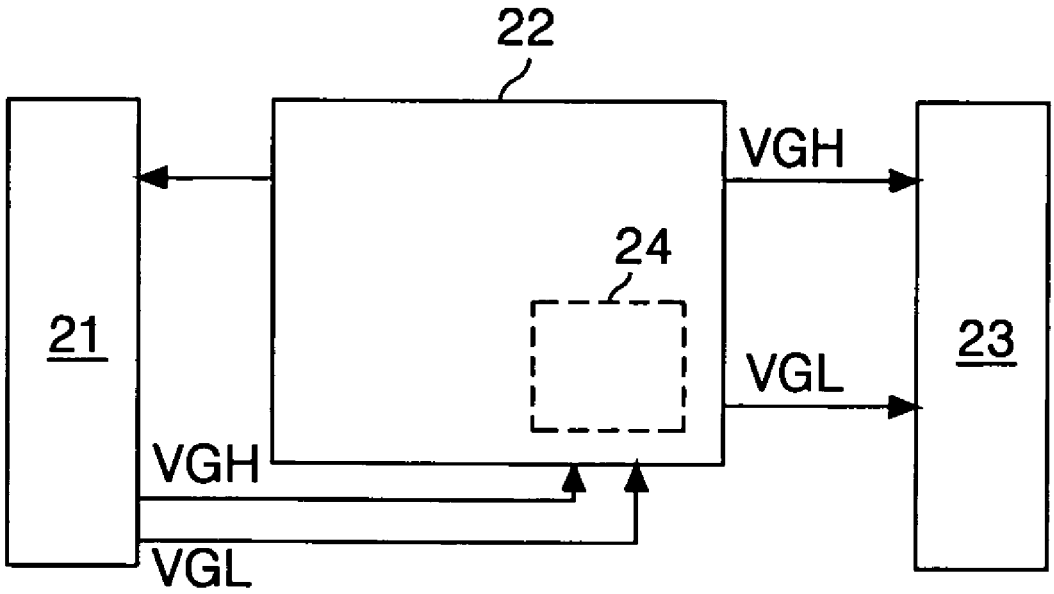
FIG. 2 shows a gate voltage controlling apparatus according to a first embodiment of the present invention.

FIG. 2 shows a gate voltage controlling apparatus according to a first embodiment of the present invention.

Figure 3:
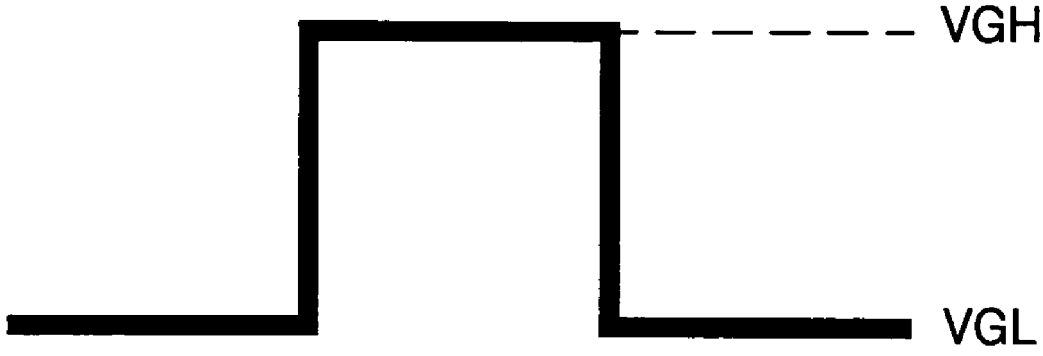
FIG. 3 depicts a gate high voltage and a gate low voltage.

Referring to FIG. 2, in the gate voltage controlling apparatus, a gate high voltage VGH and a gate low voltage VGL generated by a first power supply 22 and a second power supply 21, respectively, are applied, via a gate voltage controller 24, to a gate driver 23. At this time, the gate high voltage VGH and the gate low voltage VGL have a voltage difference from each other as seen from FIG. 3. Herein, the gate low voltage VGL is a voltage supplied to the gate line during a non-scanning period. The gate high voltage VGH is a high-level voltage that exceeds a threshold voltage for driving a thin film transistor of the liquid crystal display panel and that is supplied to the gate line during a scanning period.

Figure 4:
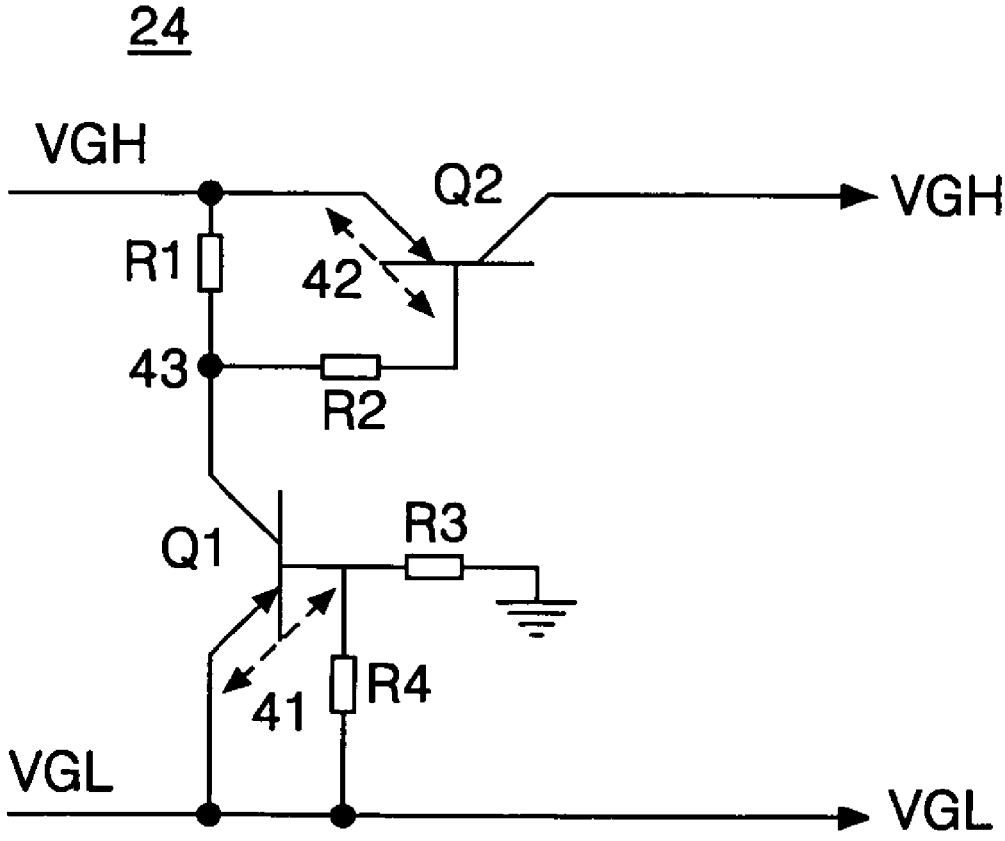
FIG. 4 is a circuit diagram of the gate voltage controller shown in FIG. 2.

FIG. 4 is a circuit diagram of the gate voltage controller 24 shown in FIG. 2.

Referring to FIG. 4, the gate voltage controller 24 allows the gate low voltage VGL to be applied to the gate driver at an earlier time than the gate high voltage VGH. Next, a voltage difference 41 turns on a first transistor Q1 to form a voltage at a node 43 and a voltage difference 42 turns on a second transistor Q2 to form a voltage at the output of Q2, so that the gate high voltage VGH is applied to the gate driver 23. The gate voltage controlling apparatus according to the first embodiment of the present invention first supplies the gate low voltage VGL as a low-level voltage to the gate driver 23 and thereafter supplies the gate high voltage VGH as a high-level voltage thereto, so that it can stably drive the gate driver to minimize any defects in the gate driver.

The first transistor Q1 is turned on and thereafter the second transistor Q2 is turned on by a RC delay value due to a parasitic capacitance of the second transistor Q2 and Resistors R1, R2.

In FIG. 4, R1 to R4 are bias resistors that adjust an operating voltage of the transistors Q1, Q2 and limit a current.

Figure 5:
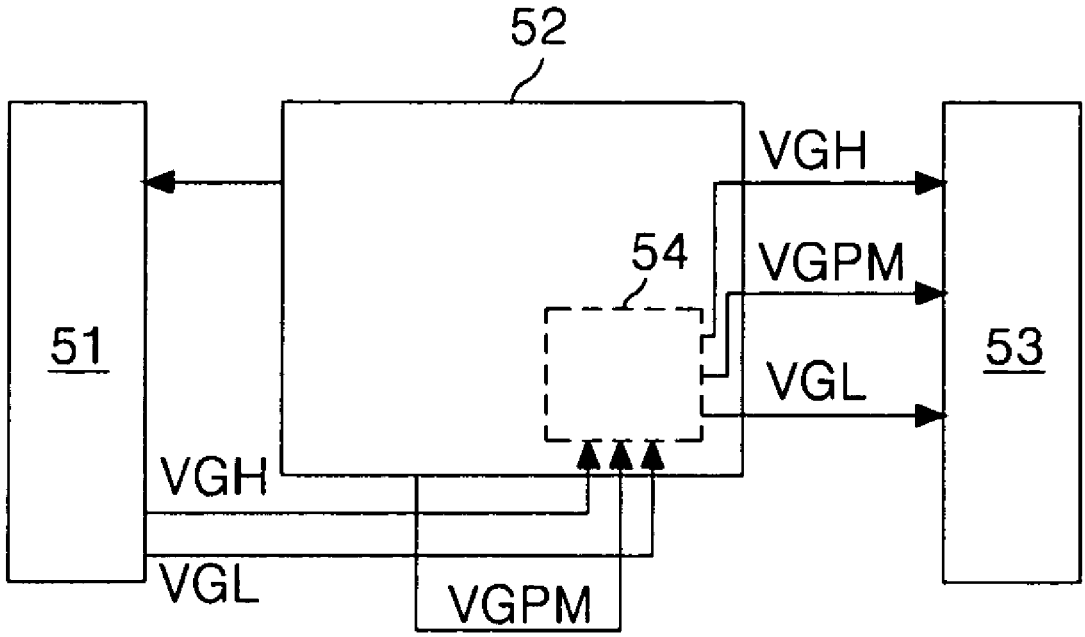
FIG. 5 shows a gate voltage controlling apparatus according to a second embodiment of the present invention.

FIG. 5 shows a gate voltage controlling apparatus according to a second embodiment of the present invention.

Figure 6:
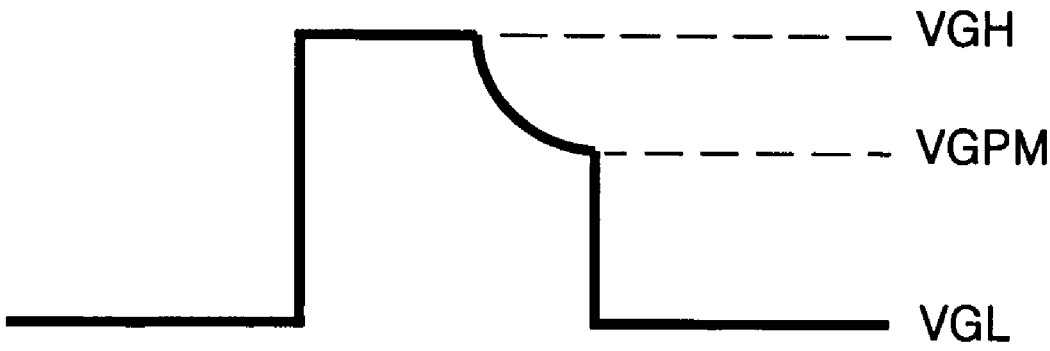
FIG. 6 depicts a gate high voltage, a gate low voltage and a gate modulated voltage.

Referring to FIG. 5, in the gate voltage controlling apparatus, a gate high voltage VGH and a gate low voltage VGL generated by a first power supply 52 and a second power supply 51, respectively, and a gate modulated voltage VGPM output from the first power supply 52 are applied, via a gate voltage controller 54, to a gate driver 53. At this time, the gate high voltage VGH, the gate low voltage VGL, and the gate modulated voltage VGMP have a voltage difference from each other as seen from FIG. 6. The gate low voltage VGL is a voltage supplied to the gate line during a non-scanning period. The gate high voltage VGH is a high-level voltage that exceeds a threshold voltage for driving a thin film transistor of the liquid crystal display panel and that is supplied to the gate line during a scanning period. The gate modulated voltage VGPM is a voltage supplied at the edge of the gate high voltage VGH to reduce a voltage difference between the gate high voltage VGH and the gate low voltage VGL, thereby relieving a delay phenomenon existing during a falling time of a gate pulse and reducing a flicker phenomenon.

Figure 7:
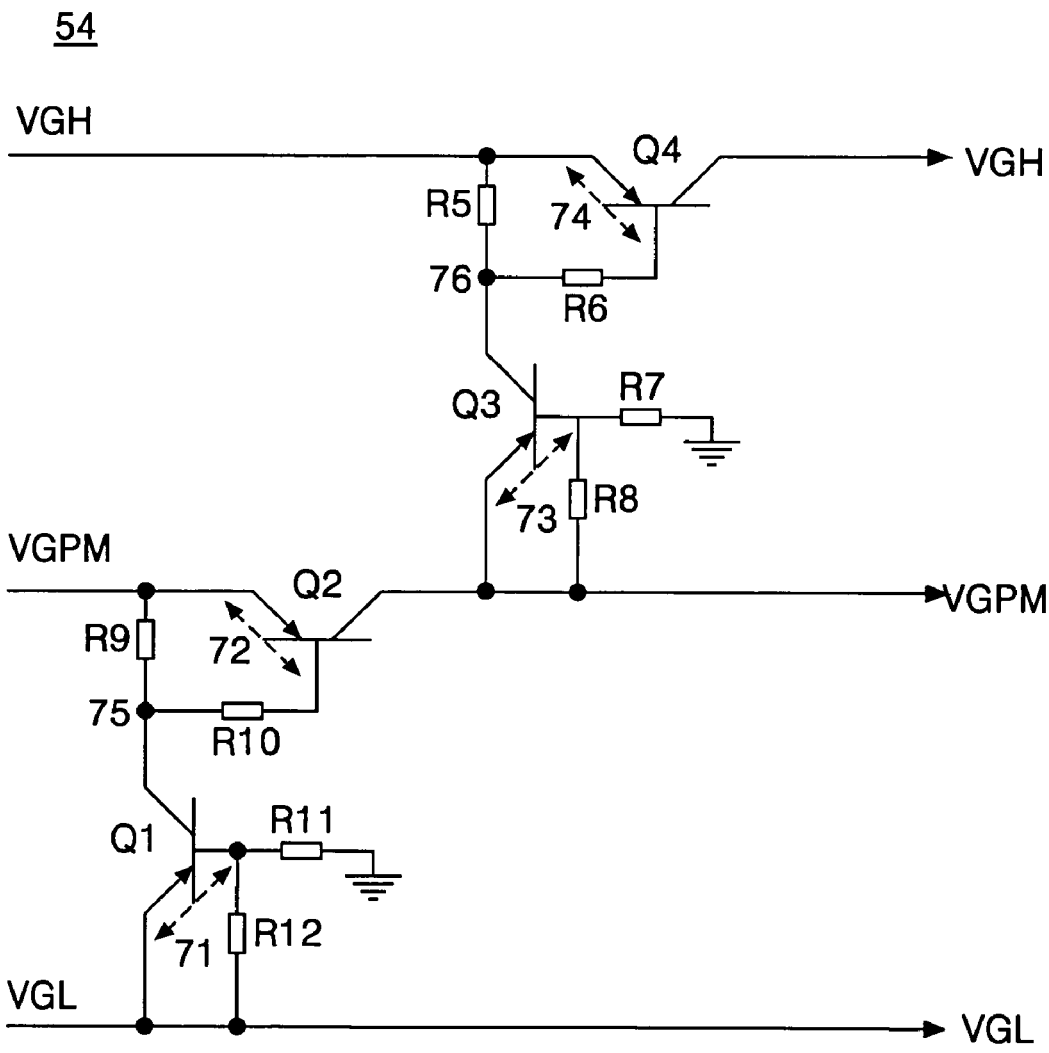
FIG. 7 is a circuit diagram of the gate voltage controller shown in FIG. 5.

FIG. 7 is a circuit diagram of the gate voltage controller 54 shown in FIG. 5.

First, the gate voltage controller 54 allows the gate low voltage VGL output from the first power supply 52 to be applied to the gate driver at an earlier time than the gate modulated voltage VGMP and the gate high voltage VGH. Next, a voltage difference 71 turns on a first transistor Q1 to form a voltage at a node 75 and a voltage difference 72 turns on a second transistor Q2 so that the gate modulated voltage VGMP is applied to the gate driver 53. While the gate modulated voltage VGMP is being supplied, a voltage difference 73 turns on a third transistor Q3 to form a voltage at a node 76 and a voltage difference 74 turns on a fourth transistor Q4, so that the gate high voltage VGH is applied to the gate driver 53.

The gate voltage controlling apparatus according to the second embodiment of the present invention first supplies the gate low voltage VGL as a low-level voltage to the gate driver 23; and then it supplies the gate modulated voltage VGPM as a middle-level voltage thereto; and last, it supplies the gate high voltage VGH as a high-level voltage thereto, so that it can stably drive the gate driver to minimize any defects of the gate driver.

In FIG. 7, R5 to R12 are bias resistors which adjust a operating voltage of the transistors Q1 to Q4 and limit a current.

In the gate voltage controlling apparatus according to the first and second embodiments of the present invention, the transistors are delayed by a RC delay value, thereby supplying a gate voltage to the gate driver sequentially from a lower voltage followed by a higher voltage. The RC delay value for delaying turning-on operations of the transistors may be controlled by a parasitic resistance and a parasitic capacitance in the transistor or by a separate connection of a resistor and a capacitor between the base and the emitter of the transistor.

As described above, the gate voltage controlling apparatus and method supplies the gate voltage to the gate driver so that there is a time difference between the lowest voltage and the highest voltage, so that it can stably drive the gate driver and protect the gate driver, thereby minimizing any defects in the gate driver.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A gate voltage controlling apparatus for a liquid crystal display, comprising:

a power supply that generates at least two gate voltages having different voltage levels;

a gate driver that generates a scanning pulse that selects a display line using the at least two gate voltages having different voltage levels; and a gate voltage control means that supplies the gate voltages to the gate driver in a sequence of a lower voltage followed by a higher voltage, wherein the gate voltages include a gate low voltage corresponding to a low logical voltage of the scanning pulse, a gate high voltage corresponding to a high logical voltage of the scanning pulse, and a gate modulated voltage between the gate low voltage and the gate high voltage, wherein the gate voltage control means includes a first power wire that supplies the gate low voltage, a second power wire that supplies the gate high voltage, a third power wire that supplies the gate modulated voltage, wherein the gate voltage control means further includes a first transistor connected between the first power wire and the third power wire to control a voltage at a first node between the first power wire and the third power wire in response to a voltage on the first power wire, a second transistor controlled by different voltage of between the voltage of the first node and a voltage of the third power wire, a third transistor connected between the second power wire and the third power wire to control a voltage at a second node between the second power wire and the third power wire in response to a voltage on the third power wire and a fourth transistor controlled by different voltage of between the voltage of the second node and a voltage of the second power wire, wherein the gate voltage control means first supplies the gate low voltage as a low-level voltage to the gate driver and then supplies the gate modulated voltage as a middle-level voltage to the gate driver and last supplies the gate high voltage as a high-level voltage to the gate driver, wherein the first transistor turned on to form a voltage at the first node according to a different voltage of between a base electrode and a emitter electrode of the first transistor and then a different voltage of between a base electrode and a emitter electrode of the second transistor turn on the second transistor so that the gate modulated voltage is supplied to the gate driver, wherein the third transistor turned on to form a voltage at the second node according to a different voltage of between a base electrode and a emitter electrode of the third transistor, while the gate modulated voltage is supplied, and then a different voltage of between a base electrode and emitter electrode of the fourth transistor turn on the fourth transistor so that the gate high voltage is supplied to the gate driver.

2. The voltage controlling apparatus according to claim 1, wherein the first transistor, the second transistor, the third transistor, and the fourth transistor are turned on sequentially due to an RC delay value.

3. A gate voltage controlling method for a liquid crystal display comprising:

generating at least two gate voltages having different voltage levels to a gate voltage control means;

supplying the gate voltages to the gate driver in a sequence of a lower voltage followed by a higher voltage; and generating a scanning pulse for selecting a display line using the gate driver supplied with the gate voltages, wherein the gate voltages include a gate low voltage corresponding to a low logical voltage of the scanning pulse, a gate high voltage corresponding to a high logical voltage of the scanning pulse, and a gate modulated voltage between the gate low voltage and the gate high voltage, wherein the gate voltage control means includes a first power wire that supplies the gate low voltage, a second power wire that supplies the gate high voltage, a third power wire that supplies the gate modulated voltage, wherein supplying the gate voltage includes closing a current path of a second power wire that supplies the gate high voltage in response to a voltage on a third power wire that supplies the gate modulated voltage and closing a current path of a third power wire that supplies the gate modulated voltage in response to a voltage on the first power wire, wherein the gate voltage control means further includes a first transistor connected between the first power wire and the third power wire to control a voltage at a first node between the first power wire and the third power wire in response to a voltage on the first power wire, a second transistor controlled by different voltage of between the voltage of the first node and a voltage of the third power wire, a third transistor connected between the second power wire and the third power wire to control a voltage at a second node between the second power wire and the third power wire in response to a voltage on the third power wire and a fourth transistor controlled by different voltage of between the voltage of the second node and a voltage of the second power wire, wherein the gate voltage control means first supplies the gate low voltage as a low-level voltage to the gate driver and then supplies the gate modulated voltage as a middle-level voltage to the gate driver and last supplies the gate high voltage as a high-level voltage to the gate driver, wherein the first transistor turned on to form a voltage at the first node according to a different voltage of between a base electrode and a emitter electrode of the first transistor and then a different voltage of between a base electrode and a emitter electrode of the second transistor turn on the second transistor so that the gate modulated voltage is supplied to the gate driver, wherein the third transistor turned on to form a voltage at the second node according to a different voltage of between a base electrode and a emitter electrode of the third transistor, while the gate modulated voltage is supplied, and then a different voltage of between a base electrode and emitter electrode of the fourth transistor turn on the fourth transistor so that the gate high voltage is supplied to the gate driver.

4. A gate voltage controlling apparatus for a liquid crystal display, comprising:

a power supply that generates at least two gate voltages having different voltage levels;

a gate driver that generates a scanning pulse that selects a display line using the at least two gate voltages having different voltage levels; and a gate voltage control means that delays a higher voltage of the voltages to be supplied to the gate driver, wherein the gate voltages include a gate low voltage corresponding to a low logical voltage of the scanning pulse, a gate high voltage corresponding to a high logical voltage of the scanning pulse, and a gate modulated voltage between the gate low voltage and the gate high voltage, wherein the gate voltage control means includes a first power wire that supplies the gate low voltage, a second power wire that supplies the gate high voltage, a third power wire that supplies the gate modulated voltage, wherein the gate voltage control means further includes a first transistor connected between the first power wire and the third power wire to control a voltage at a first node between the first power wire and the third power wire in response to a voltage on the first power wire, a second transistor controlled by different voltage of between the voltage of the first node and a voltage of the third power wire, a third transistor connected between the second power wire and the third power wire to control a voltage at a second node between the second power wire and the third power wire in response to a voltage on the third power wire and a fourth transistor controlled by different voltage of between the voltage of the second node and a voltage of the second power wire, wherein the gate voltage control means first supplies the gate low voltage as a low-level voltage to the gate driver and then supplies the gate modulated voltage as a middle-level voltage to the gate driver and last supplies the gate high voltage as a high-level voltage to the gate driver, wherein the first transistor turned on to form a voltage at the first node according to a different voltage of between a base electrode and a emitter electrode of the first transistor and then a different voltage of between a base electrode and a emitter electrode of the second transistor turn on the second transistor so that the gate modulated voltage is supplied to the gate driver, wherein the third transistor turned on to form a voltage at the second node according to a different voltage of between a base electrode and a emitter electrode of the third transistor, while the gate modulated voltage is supplied, and then a different voltage of between a base electrode and emitter electrode of the fourth transistor turn on the fourth transistor so that the gate high voltage is supplied to the gate driver.

5. The gate voltage controlling apparatus according to claim 4, wherein the first transistor, the second transistor, the third transistor, and the fourth transistor are turned on sequentially due to an RC delay value.

* * * * *